US006085561A

United States Patent [19]

Yao

[11] Patent Number: 6,085,561

[45] Date of Patent: Jul. 11, 2000

[54] LOCK ASSEMBLY ALLOWING THE HANDLES THEREOF ROTATED BY A LARGE ANGLE

[75] Inventor: Celina Yao, Nan Tou Hsien, Taiwan

[73] Assignee: Shyang Feng Electric & Machinery Co., Ltd., Nan Tou Hsien, Taiwan

[21] Appl. No.: 09/268,346

[22] Filed: Mar. 16, 1999

[51] Int. Cl.[7] ..... E05B 13/10

[52] U.S. Cl. ..... 70/472; 70/149; 70/223; 70/224

[58] Field of Search ..... 70/472, 149, 218, 70/221–224, 422; 292/DIG. 27

[56] References Cited

U.S. PATENT DOCUMENTS

| | | | |
|---|---|---|---|
| 4,920,773 | 5/1990 | Surko, Jr. | 70/149 X |
| 5,125,696 | 6/1992 | Robida et al. | 292/DIG. 61 X |
| 5,177,987 | 1/1993 | Shen | 70/224 |
| 5,598,726 | 2/1997 | Cordle | 70/224 |
| 5,784,909 | 7/1998 | Huang | 70/224 |
| 5,809,815 | 9/1998 | Lee | 70/224 X |
| 5,868,018 | 2/1999 | Kang | 70/224 X |

FOREIGN PATENT DOCUMENTS

| | | | |
|---|---|---|---|
| 12097 | 7/1910 | France | 70/149 |
| 600389 | 7/1934 | Germany | 70/223 |
| 49311 | 9/1931 | Norway | 70/223 |

*Primary Examiner*—Lloyd A. Gall
*Attorney, Agent, or Firm*—Rosenberg, Klein & Lee

[57] ABSTRACT

A lock assembly includes a tube received in an outer handle and a first driving tube is rotatably received in the tube. The tube has a cruciform groove defined through the wall thereof and a driving disk is movably received in the first driving tube and has two slots with two protrusions of the driving disk extending through the two slots. An inner handle has an actuating plate extending therethrough which is fixedly connected to the driving disk so that when locking the lock assembly by pushing the lock button, one of the protrusions of the driving disk is moved to be received in the transverse portion of the cruciform groove so that the handles are allowed to rotate a larger rotational angle.

1 Claim, 10 Drawing Sheets

LOCK ASSEMBLY ALLOWING THE HANDLES THEREOF ROTATED BY A LARGE ANGLE

FIELD OF THE INVENTION

The present invention relates to a lock assembly, and more particularly, to a lock assembly having a tube with a cruciform groove defined therethrough the wall thereof so that when the lock assembly is locked, the actuating disk is located in the transverse portion of the cruciform groove so that it can be freely rotated.

BACKGROUND OF THE INVENTION

A conventional lock assembly generally includes an inner handle to which a lock button is received and an outer handle in which a tumbler cylinder is received. The lock button has an actuating plate to be connected to an actuating disk which is connected to a driving tube so that when rotating the inner handle, the driving tube is rotated by the rotation of the actuating disk to retract the latch bolt. The tumbler cylinder is connected to a second driving tube which is rotated when the outer handle is rotated and retract the latch bolt. It is to be noted that the parts in the lock assembly generally are small and have a thin wall so that if a user rotates the inner handle or the outer handle violently by a large rotation angle, these parts could be damaged and/or permanently deformed. The handle could be rotated by a large torque unintentionally and the internal parts of the lock assembly could be deformed.

The present invention intends to provide a lock assembly which allows the handles thereof to be rotated by a large angle without damaging the parts in the lock assembly when the lock assembly is in a locked position.

The lock assembly has a tube having cruciform groove defined through the wall thereof so that the actuating disk is rotatably received in the transverse portion of the cruciform groove such that when the handles are rotated by a large angle, the actuating disk can be rotated within the transverse portion of the cruciform groove.

SUMMARY OF THE INVENTION

In accordance with one aspect of the present invention, there is provided a lock assembly comprising an outer handle with a tumbler cylinder received therein and a inner handle, a retractor with a latch bolt is connected between the inner handle and the outer handle. A tube has a cruciform groove defined through the wall thereof and is connected to the outer handle. A first driving block extends radially outward therefrom. A first driving tube is rotatably received in the tube and corotatably connected to the tumbler cylinder. A second driving block extends radially outward therefrom. The first driving tube has two first slots defined through the wall thereof and a driving disk is movably received in the first driving tube, wherein the driving disk has two protrusions extending therefrom and received in the two first slots.

The inner handle has a second driving tube received therein and an actuating plate extends through the second driving tube. A lock button is connected to the first end of the actuating plate and the second end of the actuating plate has a first lug and a second lug respectively extending laterally therefrom. The second end of the actuating plate is fixedly connected to the driving disk. The latch bolt is engaged with the first driving block and the second driving block.

A second driving tube is connected to the inner handle and the actuating plate extends through the driving tube. A third driving block extends radially from the second driving tube and is engaged with the retractor. When the lock assembly is locked by pushing the lock button, one of the protrusions of the driving disk is moved to be located in the transverse portion of the cruciform groove.

The object of the present invention is to provide a lock assembly which allows the handles thereof to be rotated by a large rotational angle without damaging the parts in the lock assembly.

Further objects, advantages, and features of the present invention will become apparent from the following detailed description with appropriate reference to the accompanying drawings.

DETAILED DESCRIPTION OF THE PREFERRED EMBODIMENTS

Figure 1:
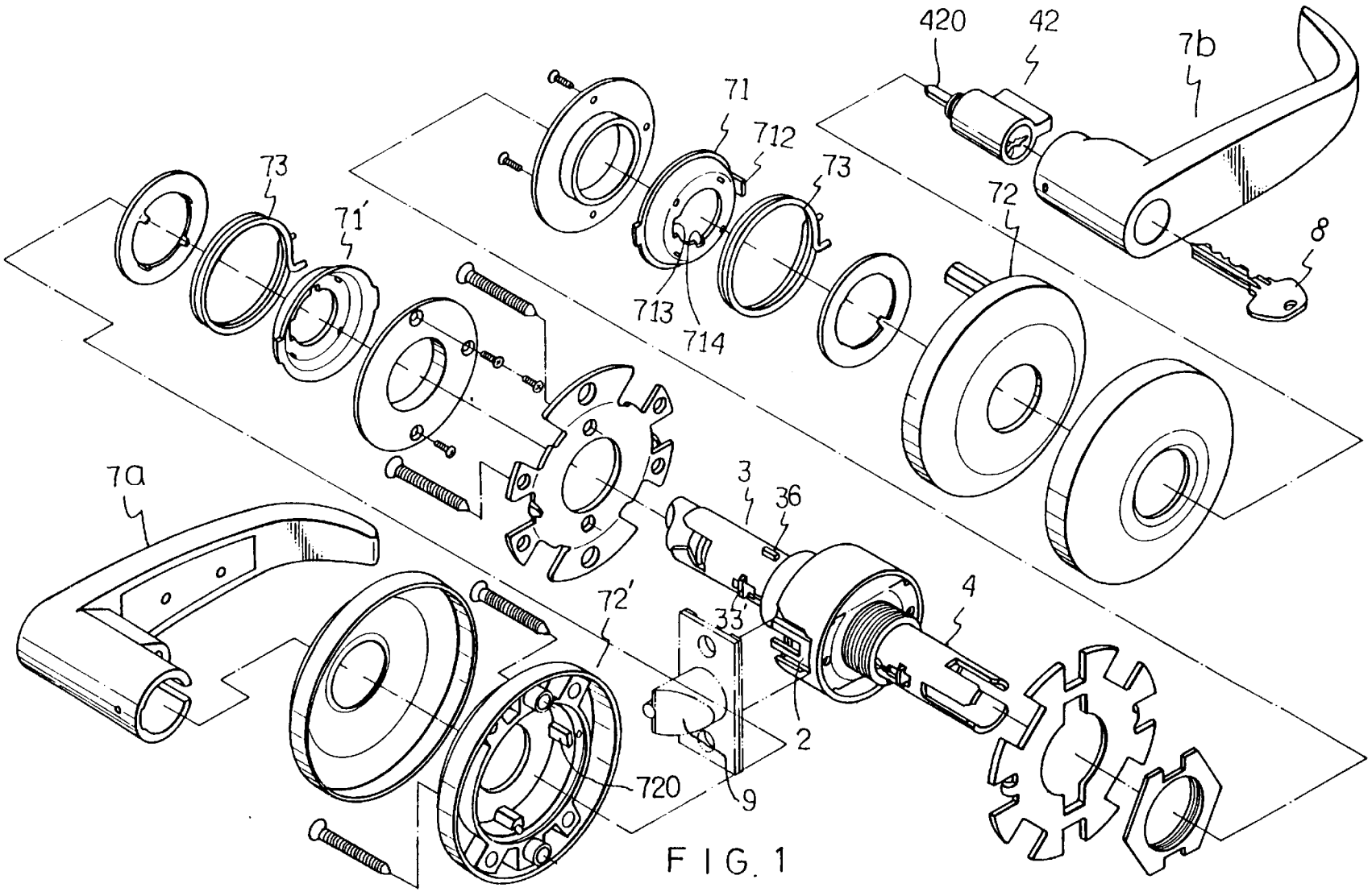
FIG. 1 is an exploded view of the main part of the lock assembly in accordance with the present invention and the two handles.
Figure 2:
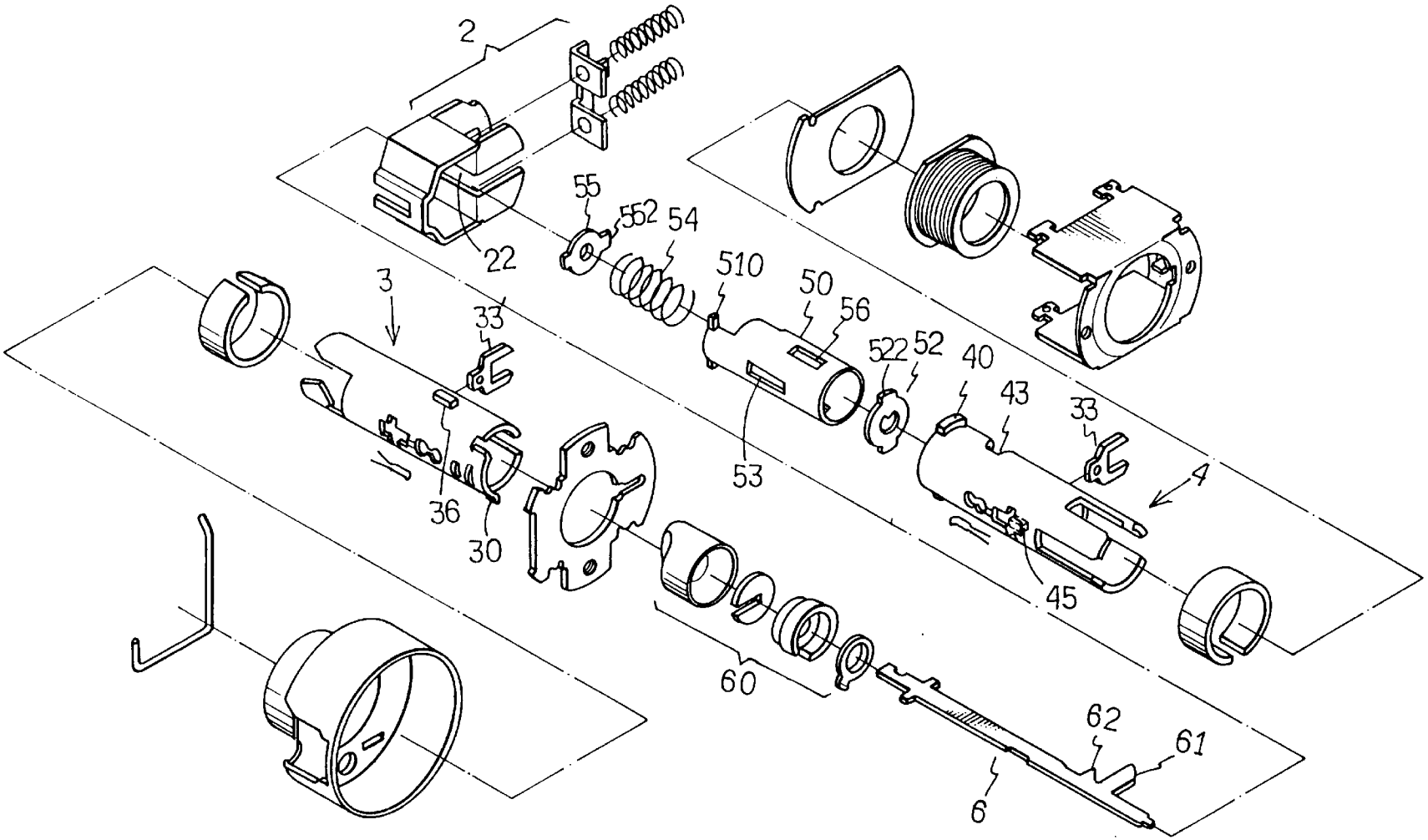
FIG. 2 is an exploded view of the main part of the lock assembly in accordance with the present invention.
Figure 3:
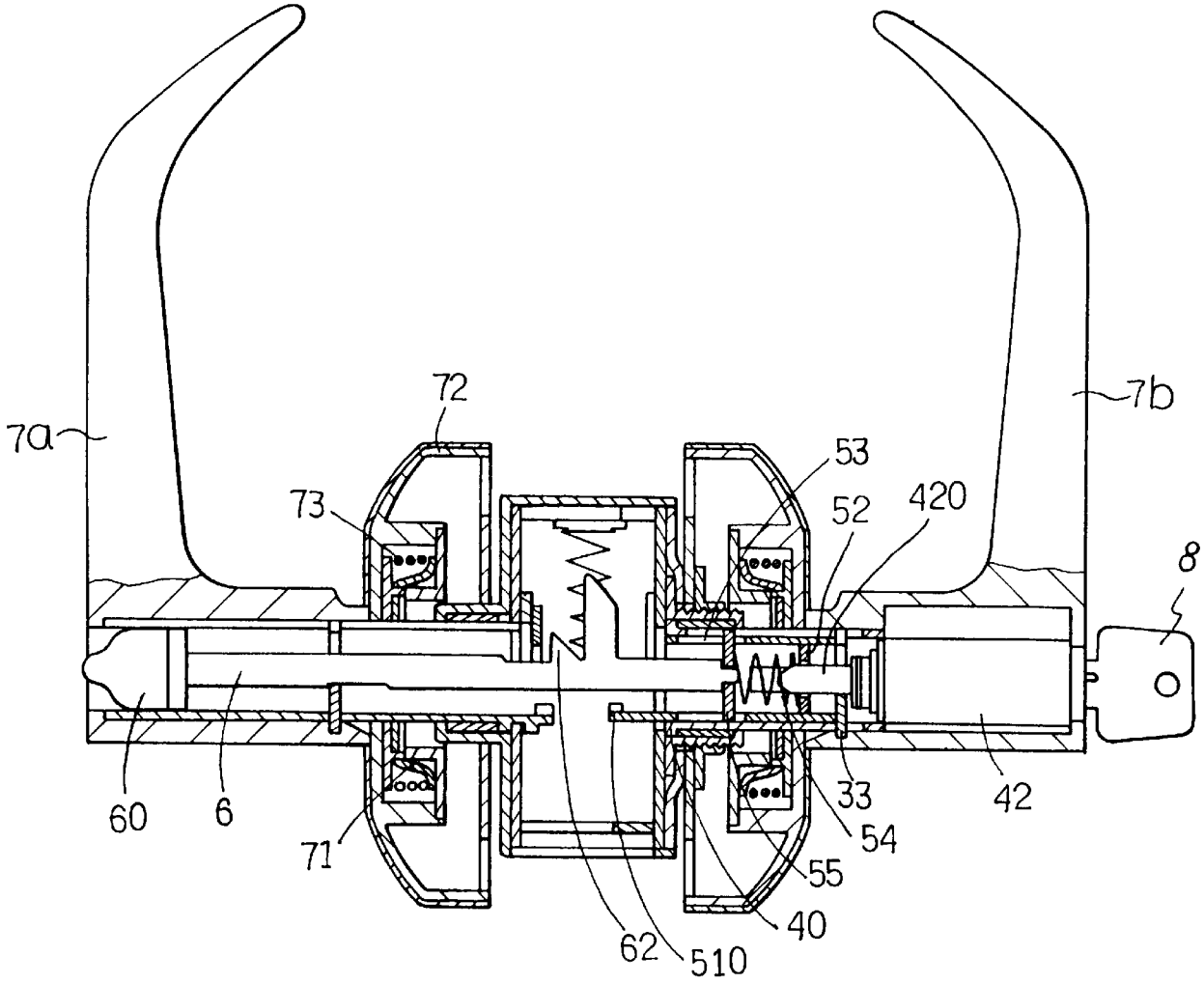
FIG. 3 is a side elevational view, partly in section, of the lock assembly in accordance with the present invention when the lock assembly is locked by pushing the lock button into the inner handle.
Figure 5:
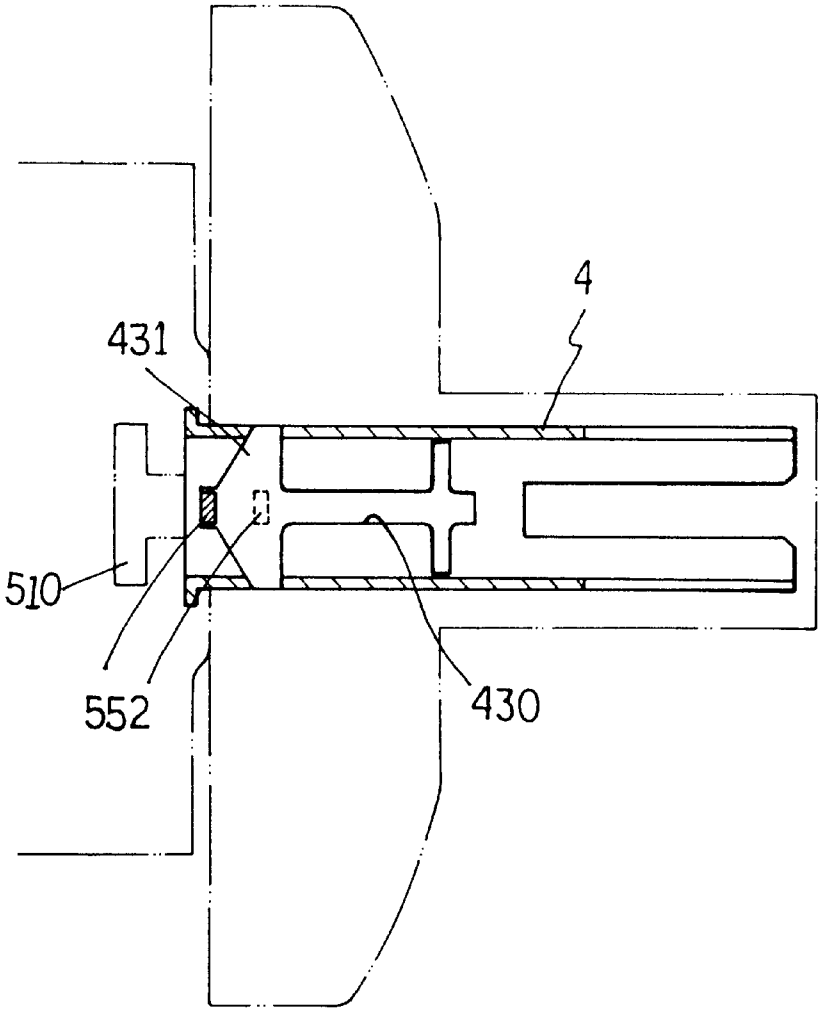
FIG. 5 is an illustrative view to show the protrusion of the driving disk is moved in the transverse portion of the cruciform groove in the first driving tube.

Referring to FIGS. 1 to 3, the lock assembly in accordance with the present invention comprises an outer handle 7*b* with a tumbler cylinder 42 received therein and an inner handle 7*a*, and a retractor 2 connected between the inner handle 7*a* and the outer handle 7*b* wherein a latch bolt 9 is retractably received in the retractor 2. A tube 4 is connected to the outer handle 7*b* and has a cruciform groove 43 defined through the wall thereof, the cruciform groove 43 including a longitudinal portion 430 and a transverse portion 431 as shown in FIG. 5. A first driving block 40 and an engaging boss 45 respectively extend radially outward from the tube 4. A first driving tube 50 is rotatably received in the tube 4 and has two first slots 53 and two second slots 56 respectively defined through the wall thereof. A connecting disk 52 is movably received in the first driving tube 50 and has two protrusions 522 extending therefrom which are movably received in the two second slots 56. The connecting disk 52 is fixedly connected to an operation shaft 420 of the tumbler cylinder 42 for rotation therewith. Two second driving blocks 510 extend radially outward from the first driving tube 50 and a driving disk 55 is movably received in the first driving tube 50, the driving disk 55 having two protrusions 552 extending therefrom and received in the two first slots 53.

The inner handle 7*a* has a second driving tube 3 received therein and an actuating plate 6 extends through the second driving tube 3. The actuating plate 6 has a lock button 60 connected to the first end thereof and the lock button 60 is exposed from the inner handle 7*a*. The second end of the actuating plate 6 has a first lug 61 and a second lug 62 respectively extending laterally therefrom, and the second end of the actuating plate 6 is fixedly connected to the driving disk 55. A spring 54 is biased between the driving disk 55 and the connecting disk 52. The latch bolt 9 retractably received in the retractor 2 is moved by the rotation of the first driving block 40 and the second driving block 510 as the conventional mechanism known to the persons in the art.

Figure 4:
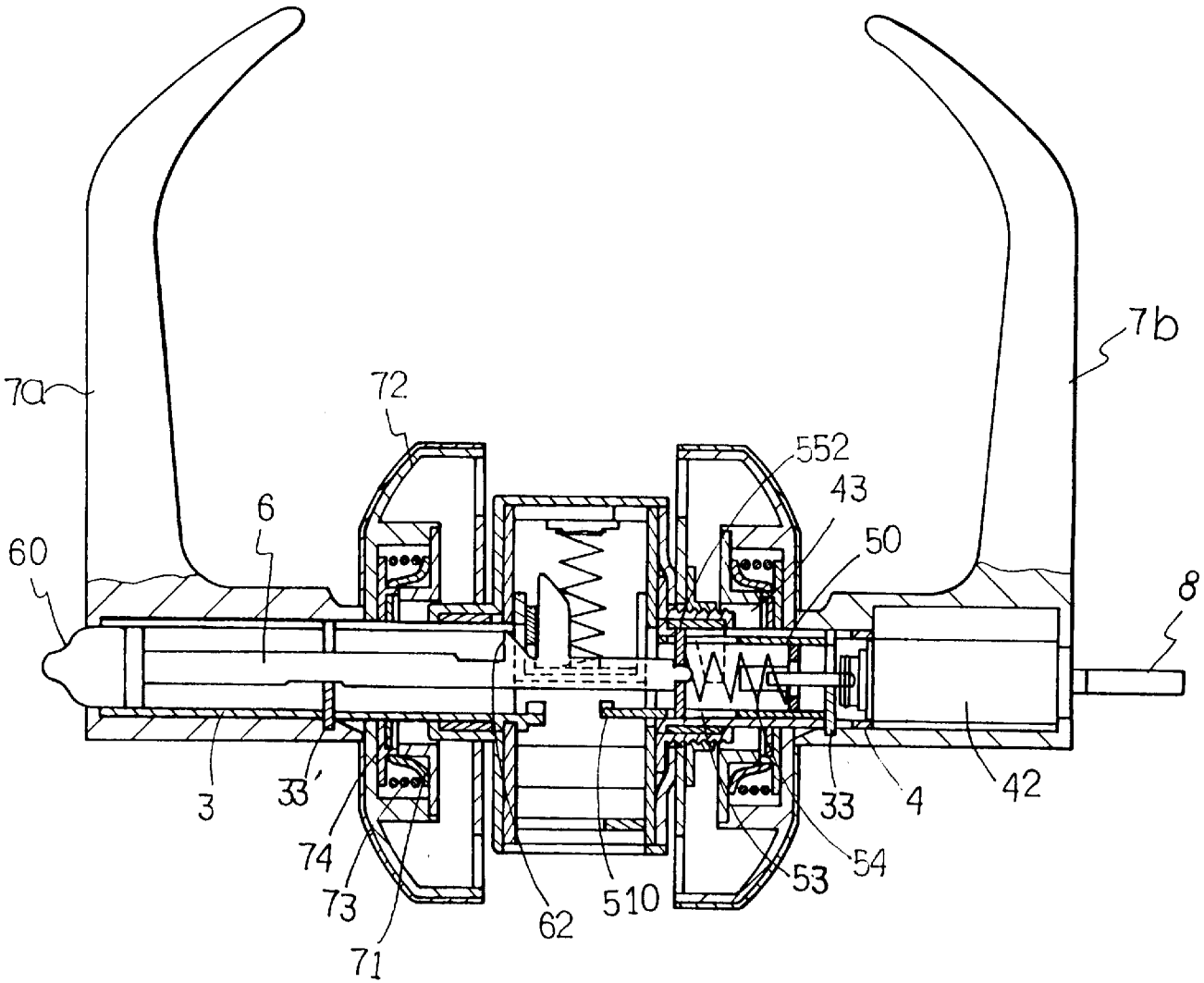
FIG. 4 is a side elevational view, partly in section, of the lock assembly in accordance with the present invention when the lock assembly is unlocked.

A second driving tube 3 is connected to the inner handle 7a and the actuating plate 6 extends through the driving tube 3. A third driving block 30 extends radially from the second drivirg tube 3 and is engaged with the retractor 2. When the lock assembly is locked by pushing the lock button 60 as shown in FIG. 3, the protrusions 552 of the driving disk 55 are moved to be located in the transverse portion 431 of the cruciform groove 43. As shown in FIG. 4, when unlocking the lock assembly either by using the key 8 rotating the tumbler cylinder 42 or rotating the inner handle 7*a*, the protrusion 552 can be rotated within the transverse portion 431 of the cruciform groove 43 so that even if the operator rotates the outer handle 7*b* by a large rotational angle, no parts in the lock assembly will be deformed or damaged.

Each of the inner handle 7*a* and the outer handle 7*b* has a torsion spring 73 connected thereto, wherein the torsion spring 73 mounted to the driving tube 3 has one end thereof engaged with a lug 712 of a cap member 71' and the torsion spring 73 mounted to the tube 4 has one end thereof engaged with a lug 712 of a cap member 71. The other end of the torsion spring 73 is engaged with the rib 720 of each of the two positioning rings 72, 72' so that the inner handle 7*a* and the outer handle 7*b* will return to their original position when releasing them.

Each of the cap members 71, 71' has a central hole defined centrally therethrough and two notches 713, 714 are defined in the periphery defining the central hole. The tube 4 has an engaging boss 45 and a stop pin 33 respectively extending radially outward therefrom and the second driving tube 3 having an engaging boss 36 and another stop pin 33' extending radially outward therefrom so that the two engaging bosses 45, 36 are respectively engaged with the two respective notches 714 of the cap members 71, and the two stop pins 33, 33' are respectively engaged with the two notches 713 of the two cap members 71, 71'.

Accordingly, because the cruciform groove 43 in the tube 4, the protrusion 552 of the driving disk 55 can be moved within the transverse portion 431 of the cruciform groove 43 so that even if the inner handle 7*a* or the outer handle 7*b* is rotated by a large angle, there is a large enough space for the protrusion 552 to move.

Figure 6:
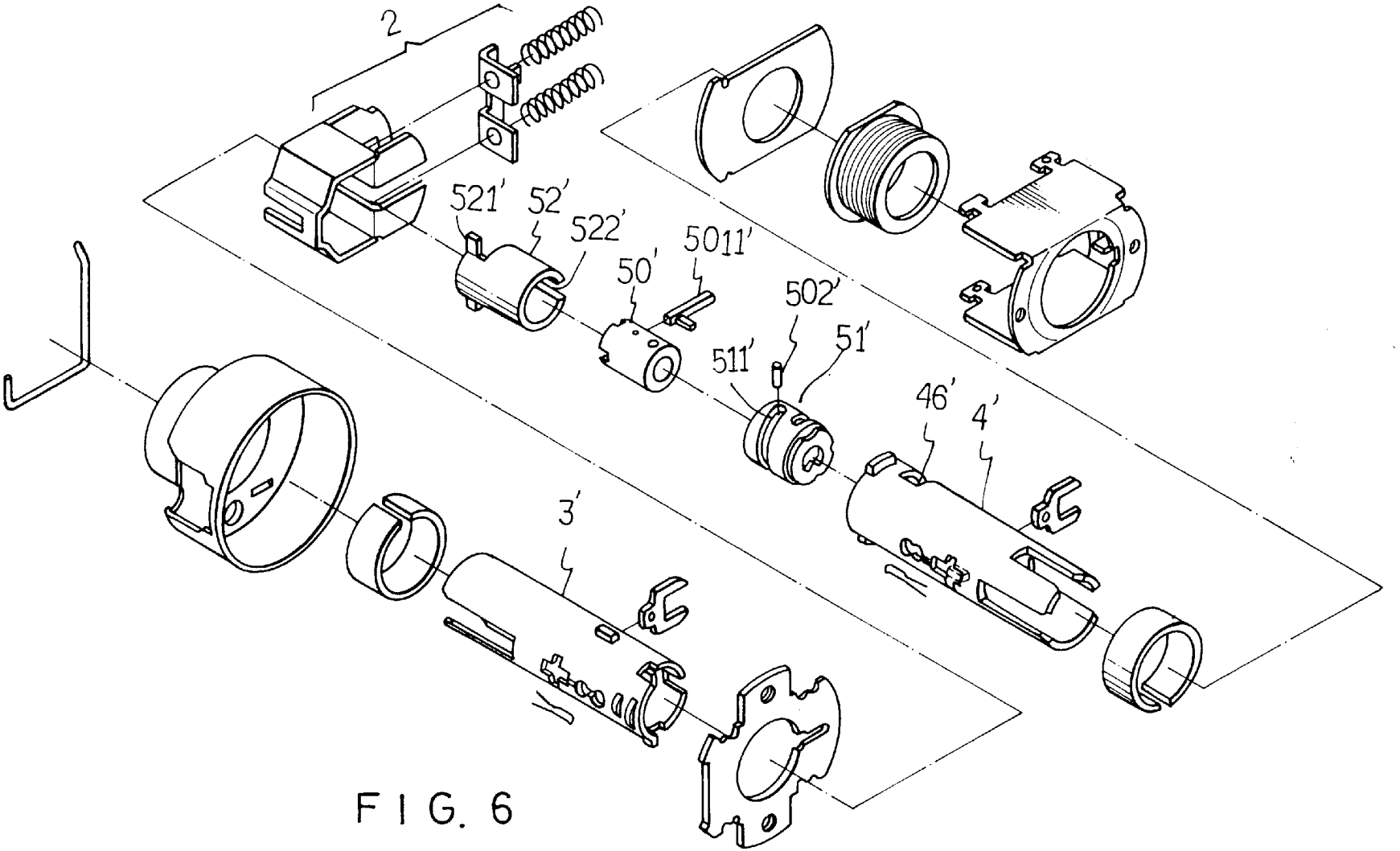
FIG. 6 is an exploded view to show another embodiment of the main part of the lock assembly in accordance with the present invention.
Figure 7:
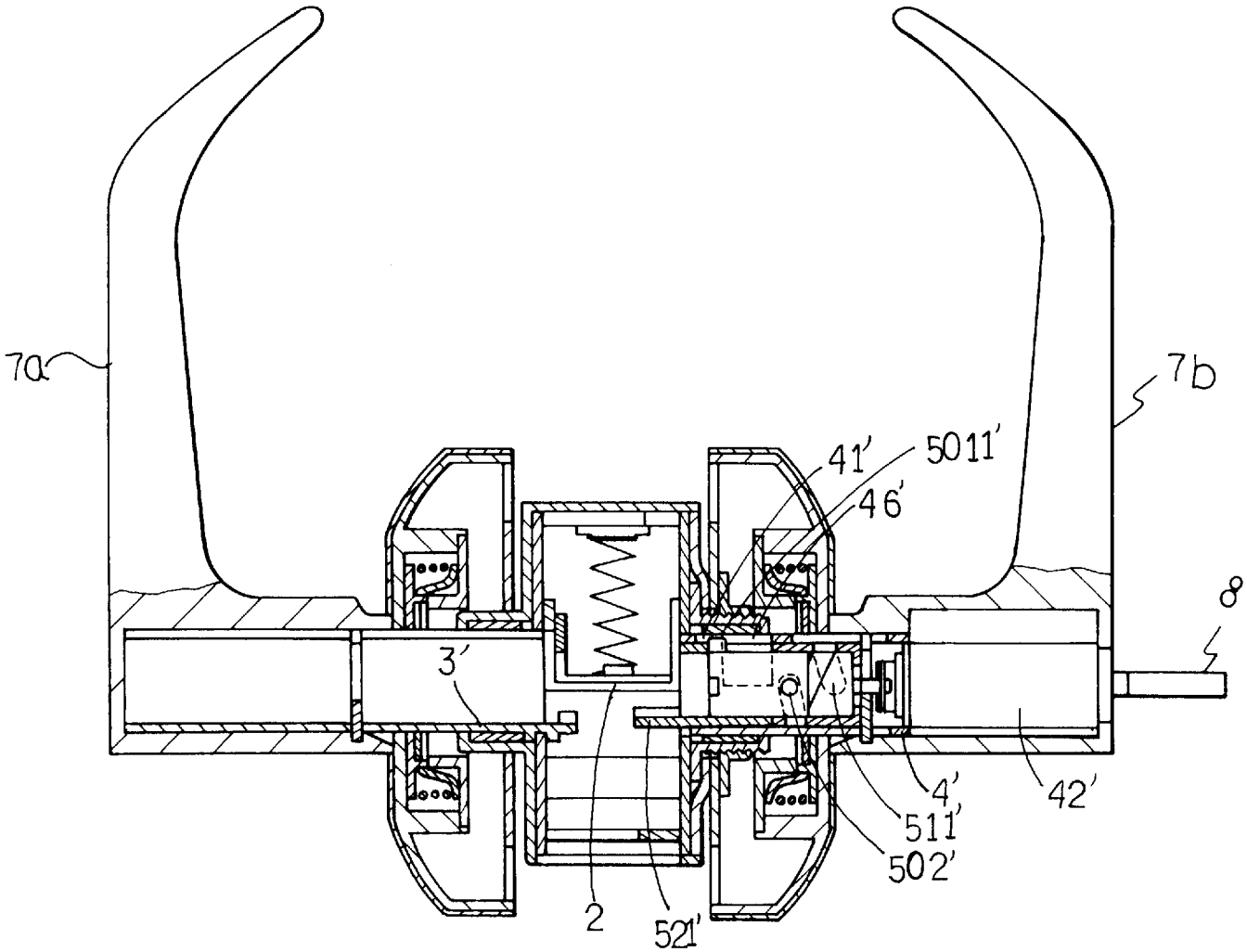
FIG. 7 is a side elevational view, partly in section, of the lock assembly as shown in FIG. 6, wherein the lock assembly is unlocked.
Figure 9:
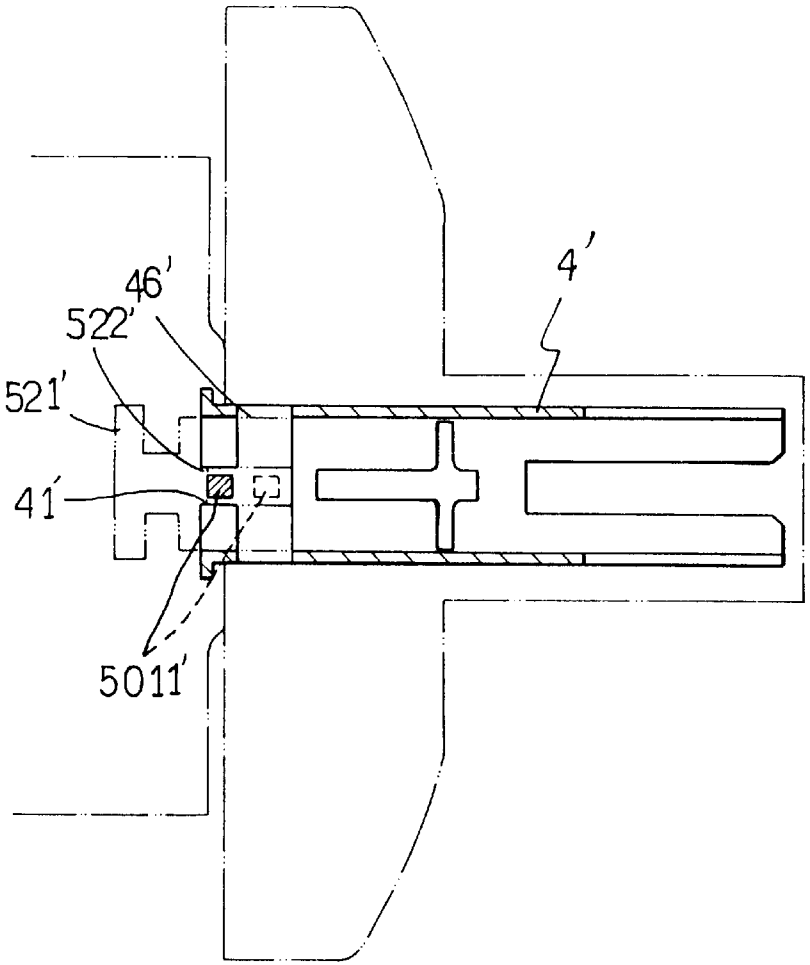
FIG. 9 is an illustrative view to illustrate the movement of the guiding member in the radial slot and the longitudinal slot in the tube.

FIGS. 6 and 7 show another embodiment of the lock assembly of the present invention, wherein the tube 4' is connected to the tumbler cylinder 42' and the outer handle 7*b*. A retaining tube 51' is received in the tube 4' and has a spiral groove 511' defined through the wall thereof. A first driving tube 50' is movably received in the retaining tube 51'. A pin 502' extends through the spiral groove 511' and connected to the first driving tube 50' which is co-rotated with the tumbler cylinder 42'. A guiding member 5011' is connected to the first driving tube 50'. The tube 4' has a radial slot 46' which communicates with a longitudinal slot 41' so that the guiding member 5011' is movably received in the radial slot 46' as shown in FIGS. 7 and 9. An outer tube 52' is mounted to the retaining tube 51' and has a slit 522' which communicates with the longitudinal slot 41' im the tube 4'.

Figure 10:
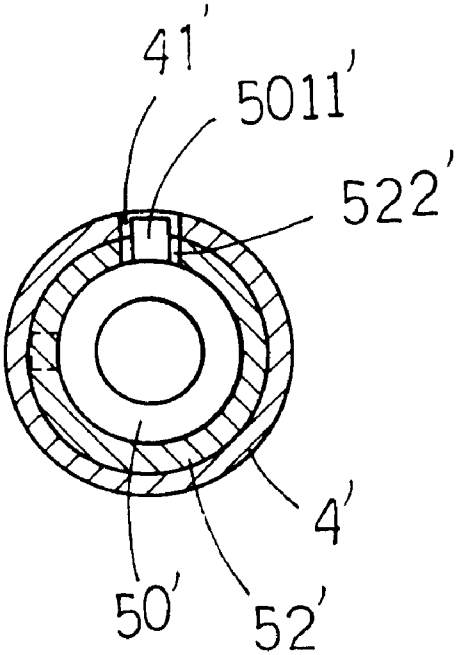
FIG. 10 is an end cross sectional view to show the guiding member received in the slit in the outer tube.

The second driving tube 3' is connected to the inner handle 7*a* with the retractor 2 connected between the second driving tube 3' and the tube 4' so that either of the inner handle 7*a* or the outer handle 7*b* is rotated, the latch bolt (not shown) is retracted by a known manner. Further referring to FIG. 10, when the lock assembly is in an opened position, the guiding member 5011' is located in the slit 522' so that when rotating the outer handle 7*b*, the outer tube 52' is rotated together with the guiding member 5011' and the latch bolt is retracted by the protrusion 521' on the outer tube 52'.

Figure 8:
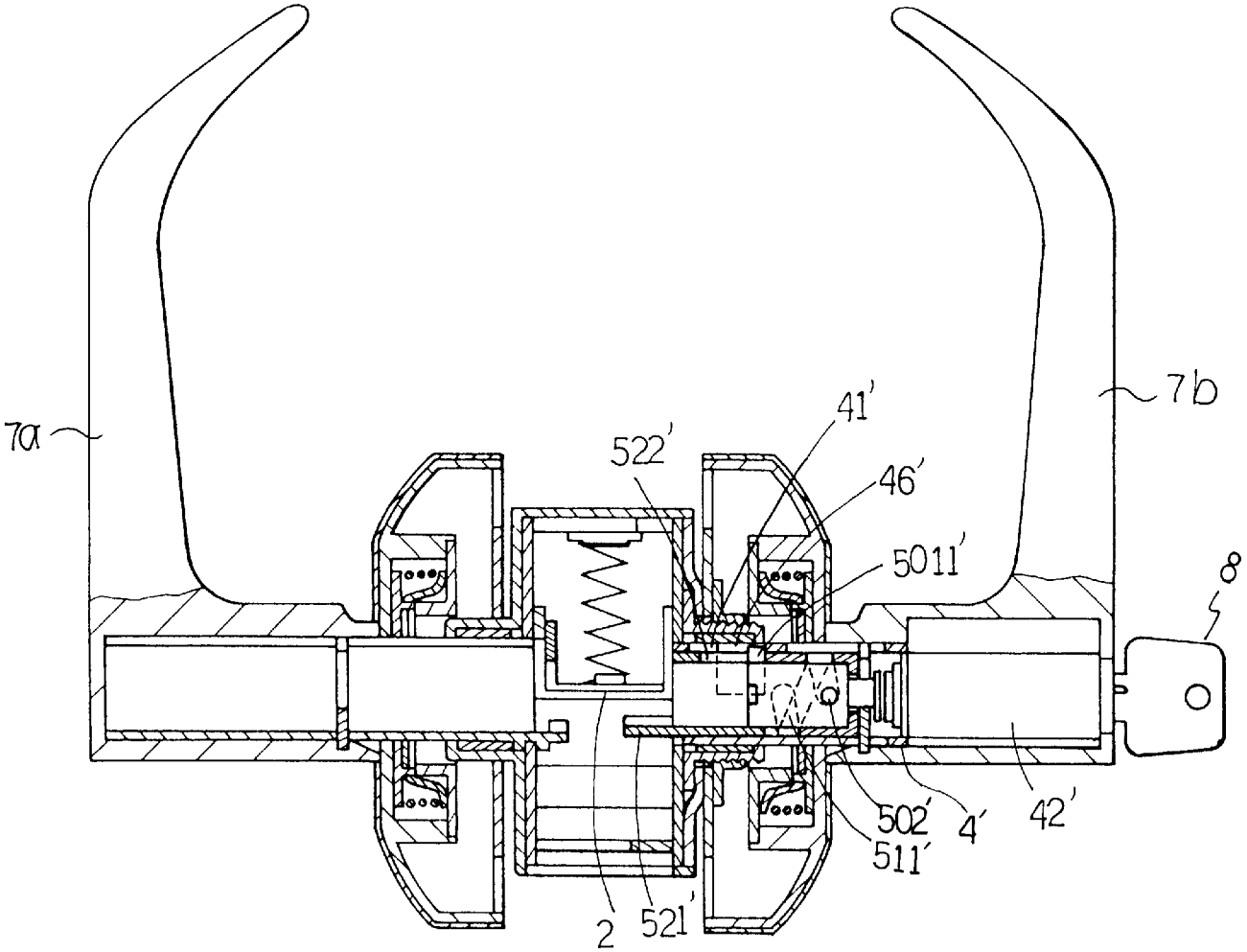
FIG. 8 is a side elevational view, partly in section, of the lock assembly as shown in FIG. 6, wherein the lock assembly is locked.
Figure 11:
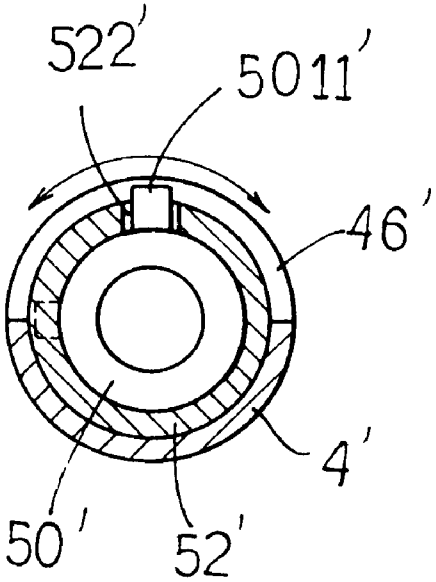
FIG. 11 is an end cross sectional view to show the guiding member received in the radial slot.

Referring to FIGS. 8, 9 and 11, when the lock assembly is locked by rotating a key 8 to rotate the first driving tube 50', the first driving tube 50' is moved in the retaining tube 51' by the pin 502' moved along the spiral groove 511' so that the first driving tube 50' is retracted in the retaining tube 51'. In the meanwhile, the guiding member 5011' is moved from the slit 522' and received in the slot 46' which extends radially through the wall of the tube 4' as shown in FIGS. 6 and 11. The guiding member 5011' is then freely rotatable within the radial slot 46'. In other words, when the lock assembly is locked, even if the outer handle 7*b* is unintentionally rotated, no internal parts of the lock assembly will be damaged.

When unlocking the lock assembly by the key 8, the first driving tube 50' is rotated and moved away from the retaining tube 51' with the pin 502' moving along the spiral groove 511'. The guiding member 5011' is therefore moved to the slit 522' again so that when rotating the outer handle 7*b*, the outer tube 52' is rotated to retract the latch bolt.

The invention is not limited to the above embodiment but various modification thereof may be made. It will be understood by those skilled in the art that various changes in form and detail may made without departing from the scope and spirit of the present invention.

What is claimed is:

1. A lock assembly comprising:

an outer handle with a tumbler cylinder received therein, a tube having a cruciform groove defined through a wall thereof and connected to said outer handle, said cruciform groove having a longitudinal portion and a transverse portion, a first driving block extending radially outward from said tube, a first driving tube rotatably received in said tube and having a pair of first longitudinally extender slots formed therein and a pair of second longitudinally extended slots formed therein and angularly offset frog said first longitudinally extended slots, a connecting disk longitudinally displacably disposed in said first driving tube having a pair of protrusions disposed in said second longitudinally extended slots, said connecting disk being fixedly connected to an operation shaft of said tumbler cylinder for rotating said first driving tube responsive to rotation of said operation shaft, said first driving tube having a second driving block extending radially outward from an end portion thereof, a driving disk movably received in said first driving tube, said driving disk having two protrusions extending therefrom and respectively received in said pair of first slots for rotation with said first driving tube, a first of said two protrusions of said driving disk extending into said cruciform groove of said tube;

an inner handle having a second driving tube received therein and an actuating plate extending through said second driving tube, a lock button connected to a first end of said actuating plate and exposed from said inner handle, a second end of said actuating plate being fixedly connected to said driving disk;

a retractor located between said inner and said outer handle, a latch bolt retractably received in said retractor and engaged with said first driving block and said second driving block; and said second driving tube being connected to said inner handle and said actuating plate extending through said second driving tube, a third driving block extending radially from said second driving tube and engaged with said retractor such that when said lock assembly is locked by pushing said lock button, said first protrusion of said driving disk is moved from said longitudinal portion of said cruciform groove to said transverse portion of said cruciform groove.

* * * * *